US007468107B2

(12) United States Patent
Tipps et al.

(10) Patent No.: US 7,468,107 B2
(45) Date of Patent: Dec. 23, 2008

(54) CARBURIZING METHOD

(75) Inventors: Jerry A. Tipps, Franklin, TN (US); Larry E. Byrnes, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/137,118

(22) Filed: May 1, 2002

(65) Prior Publication Data

US 2003/0205297 A1 Nov. 6, 2003

(51) Int. Cl.
*C23C 8/22* (2006.01)

(52) U.S. Cl. ..... 148/233; 148/206

(58) Field of Classification Search ..... 148/233, 148/223, 218, 206, 316; 252/373
See application file for complete search history.

(56) References Cited

U.S. PATENT DOCUMENTS

| | | | | | |
|---|---|---|---|---|---|
| 3,620,517 | A | * | 11/1971 | Keough | 266/130 |
| 3,650,853 | A | * | 3/1972 | Keough | 148/229 |
| 3,873,375 | A | * | 3/1975 | Bolen et al. | 148/226 |
| 3,885,995 | A | * | 5/1975 | Cunningham et al. | 148/6.35 |
| 3,950,192 | A | * | 4/1976 | Golland et al. | 148/233 |
| 4,049,472 | A | * | 9/1977 | Arndt | 148/208 |
| 4,145,232 | A | * | 3/1979 | Solomon | 148/218 |
| 4,152,177 | A | * | 5/1979 | Mantel et al. | 148/235 |
| 4,191,598 | A | * | 3/1980 | Conybear et al. | 148/216 |
| 4,191,599 | A | * | 3/1980 | Stickels et al. | 148/16.5 |
| 4,249,965 | A | * | 2/1981 | Schultz | 148/27 |
| 4,360,189 | A | | 11/1982 | Duncan et al. | 266/118 |
| 4,472,209 | A | * | 9/1984 | Langerich et al. | 148/216 |
| 4,563,223 | A | * | 1/1986 | Dawes et al. | 148/16.5 |
| 4,717,300 | A | * | 1/1988 | Alvi et al. | 411/361 |
| 4,913,749 | A | * | 4/1990 | Hengerer et al. | 148/233 |
| 5,827,375 | A | * | 10/1998 | Barbour | 148/225 |
| 5,851,313 | A | * | 12/1998 | Milam | 148/222 |
| 6,187,111 | B1 | * | 2/2001 | Waka et al. | 148/223 |
| 6,235,128 | B1 | * | 5/2001 | Chang et al. | 148/219 |
| 6,258,179 | B1 | * | 7/2001 | Takayama et al. | 148/233 |
| 2003/0089426 | A1 | * | 5/2003 | Poor et al. | 148/216 |

FOREIGN PATENT DOCUMENTS

| | | |
|---|---|---|
| DE | 4033706 | 2/1991 |
| DE | 4431007 | 3/1995 |
| DE | 19734901 | 2/1998 |

OTHER PUBLICATIONS

The ASM Handbook vol. 1 pp. 126-137 (Mar. 1990).*
The ASM Handbook vol. 4, p. 384 (Aug. 1991).*
"Metallographic", Dr. Hermann Schumann, pp. 150-152, 1974.

* cited by examiner

*Primary Examiner*—John P. Sheehan
*Assistant Examiner*—Jessee R. Roe

(57) ABSTRACT

The present invention provides a carburizing method that involves heating a steel component quickly to a relatively high carburizing temperature (e.g. 1900 degrees F. and above), contacting the component at the relatively high carburizing temperature with a methane-containing carburization atmosphere for time to form a carbon-enriched surface case on the component, and cooling the component at a relatively slow rate effective to provide a relatively soft martensite-free surface case on the component. The component then is subjected to a hardening treatment wherein the carburized component is heated to a hardening temperature in the austenitic range followed by quenching and tempering to form a tempered martensitic surface case on an underlying non-martenistic core.

30 Claims, 3 Drawing Sheets

CARBURIZING METHOD

FIELD OF THE INVENTION

The present invention relates to carburizing treatments for hardening surfaces of steel components.

BACKGROUND OF THE INVENTION

A process known as carburizing is widely employed to harden surfaces of steel gears, steel shafts, and other components to impart higher hardness, toughness, and wear resistance thereto. For example, steel vehicle transmission components typically are carburized to impart a higher hardness, toughness, and wear resistance thereto.

A typical carburizing process for vehicle transmission steel gear components involves machining a hot-forged, cold-forged or cold-rolled soft low carbon steel or alloy steel to provide close tolerance machined components, heating the machined components in a batch furnace to a temperature of 1550 to 1850 degrees F. in a gaseous carburizing atmosphere present in the furnace for a time to diffuse a predetermined amount of carbon into the surface of the component to form a carbon-enriched surface case on an underlying core of the component. After the components have been maintained at the required carburizing temperature and time, the components are quickly cooled to a lower temperature by quenching into a liquid quenchant, such as oil or water, to promote metallurgical phase changes in the component. Such metallurgical phase changes in low carbon steel components and low alloy steel components typically include the formation of a martensitic surface case on a banitic core of the component upon quenching. For a representative steel transmission component, a traditional carburizing treatment is conducted for approximately 6 hours from start to finish to produce a hardened surface case of approximately 0.025 inch depth on the component. The carburized component is quenched in oil to a temperature of 150-250 degrees F. Following quenching, the component typically is tempered in well known manner to form a tempered martensitic surface case on a banitic core of the gear component.

A problem oftentimes experienced with such carburizing treatments involves distortion of certain distortion-sensitive machined steel components, such as components having a large diameter with thin walls and/or having non-uniform/non-symmetric cross-sections, when they are quenched from the carburizing temperature to the much lower quench temperature (e.g. rapidly cooling the components from 1550 degrees F. to 250 degrees F. by oil quenching). This distortion is due to high internal stresses created by quenching the component and causes many of the quenched components to fall outside of the predetermined dimensional tolerances established for an acceptable component.

Another problem experienced with such carburizing treatments involves internal oxidation of certain steels (e.g. alloy steels) having easily oxidized alloying elements, such as Cr, where discrete oxide regions or networks are formed inside the component during the carburization treatment that can adversely affect mechanical properties of the component in service.

An object of the present invention is to provide a carburizing method that reduces the start-to-finish time to produce a carburized component.

Another object of the present invention is to provide a carburizing method that reduces distortion and internal oxidation of the components.

SUMMARY OF THE INVENTION

The present invention provides a carburizing method that involves heating a steel component quickly to a relatively high carburizing temperature (e.g. 1900 degrees F. and above), contacting the component at the relatively high carburizing temperature with a methane-containing carburizing atmosphere for time to form a carbon-enriched surface case on the component, and cooling the component at a relatively slow rate effective to provide a martensite-free, carbon-enriched surface case on the component. The component then is subjected to a hardening heat treatment wherein the component is heated to a hardening temperature in the austenitic range of the particular steel used followed by quenching and tempering to form a tempered martensitic surface case on an underlying inner non-carburized core of the hardened component. The core can comprise a mixture of ferrite and pearlite phases or mostly banite phase depending upon the steel composition and hardening parameters used. For distortion sensitive steel components, the hardening heat treatment can be conducted with the component held in a fixture to reduce distortion during quenching and tempering.

In an illustrative embodiment of the invention, a steel gear component is placed in a belt furnace and transported through a heating zone where the component is heated to a carburizing temperature of about 1950 degrees F. in about 30 minutes or less, through a carburizing zone that includes methane gas to carburize the component to a selected surface case depth, and through a cooling zone where the component is relatively slowly cooled to a lower temperature to produce a martensite-free surface case on an underlying non-carburized core of the component wherein the core comprises pearlite and ferrite. A typical lower temperature is below about 500 degrees F. where no detrimental oxide surface scale forms on the steel component in ambient air. The component then is hardened by heating to a hardening temperature in the austenitic range of the particular steel used followed by quenching and tempering to provide a tempered martensitic surface case on a ferritic/pearlitic or banitic core of the gear component. The hardening treatment optionally can be conducted in an ammonia-containing atmosphere to form a shallow depth of retained austenite at the outer surface of the carbon-enriched surface case of the hardened (quenched and tempered) gear component to improve its fatigue properties. The method of the invention can be used to reduce overall start-to-finish time to conduct the overall treatment of the component wherein the rate limiting step is the carburizing treatment. A carburizing time of approximately 2 hours is achievable in practice of embodiments of the invention. Distortion and internal oxidation can be reduced by practice of the invention.

The above and other objects and advantages of the present invention will become more readily apparent from the following detailed description taken in conjunction with the following drawings.

DESCRIPTION OF THE INVENTION

The present invention involves in one embodiment the carburizing of a steel component at a relatively high carburizing temperature in a carburizing atmosphere enriched with methane for time to provide a desired carbon content (e.g. carbon-enriched surface case) at the surface of the component followed by cooling the component at a relatively slow rate effective to provide a martensite-free, carbon-enriched surface case on the component. The methane-containing carburizing atmosphere employed in practice of the invention is typically an endothermic atmosphere (e.g. ASM class or type 302 atmosphere comprising approximately 20% CO, 40% $H_2$ and 40% $N_2$ by volume percent). The carburization of the steel component is controlled pursuant to the invention by control of the level of methane enrichment of the carburizing atmosphere at a given temperature and time of carburization. The component then is subjected to a hardening heat treatment wherein the component is heated to a hardening temperature in the austenitic range of the particular steel used followed by quenching and tempering to form a tempered martensitic surface case on an underlying core of the hardened component.

Steel components of various types can be treated pursuant to the invention. For example, components made of so-called carburizing low carbon steels and low alloy steels can be treated pursuant to the invention. Examples of such steels include, but are not limited to, ASE 1020, 5120, 8620, and other variations of carbon or alloy content to suit a specific product need. A wide variety of components having different uses can be treated pursuant to the invention and include, but are not limited to, steel gears, shafts, bearing races, bushings, racks and others for purposes of illustration.

Moreover, although the invention is described herebelow for purposes of illustration in connection with carburizing of steel gear components in a belt furnace, the invention is not so limited and be can be practiced in batch furnace(s) or other type furnace(s) that can provide the treatment conditions described.

Figure 1:
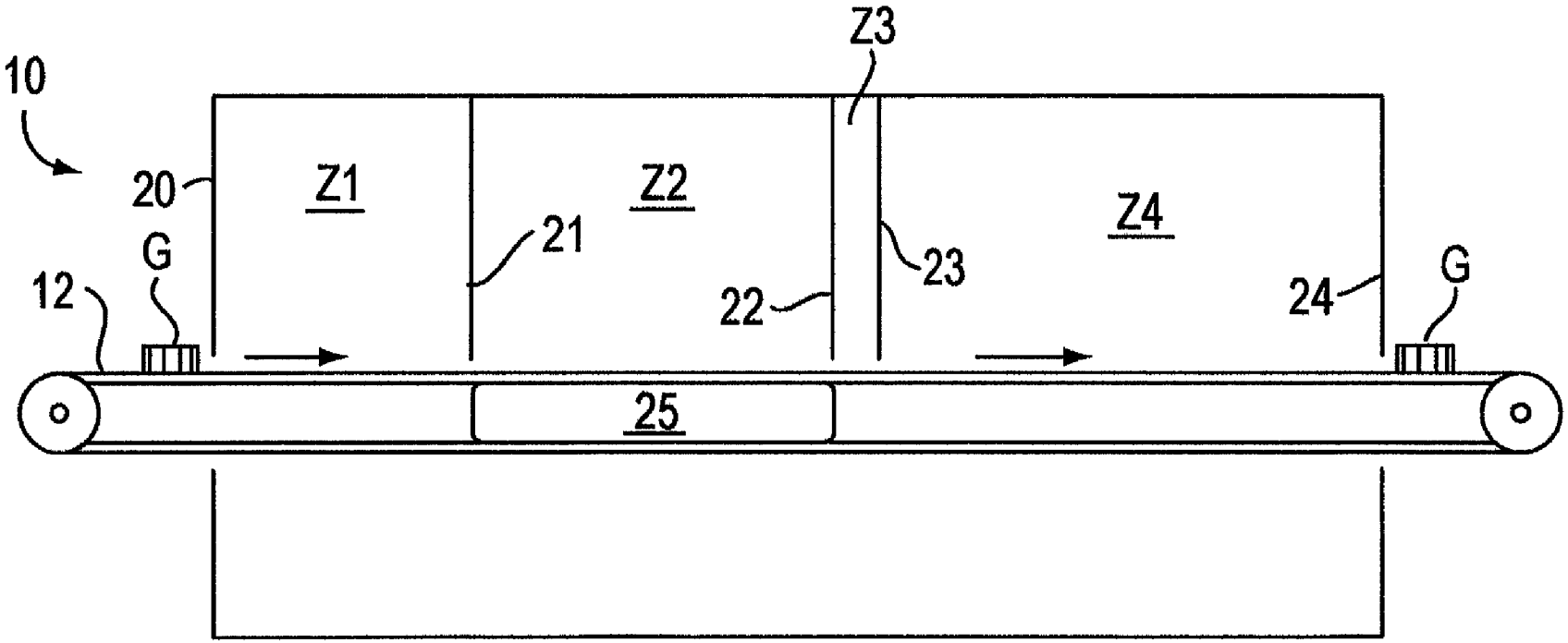
FIG. 1 is a schematic view of a belt furnace for practicing an illustrative embodiment of the invention.

In an illustrative embodiment of the invention and referring to FIG. 1, steel gear components G are placed on the endless metal (Type 314 stainless steel) mesh belt 12 of a conventional electric heated belt furnace 10 of the type used to heat treat powder metal preforms and available from Atmosphere Furnace Company, formerly Pacific International Furnace Company, Southfield, Mich. The components can be washed and dried before placement on the belt 12 or they can have a thin (non-dripping) layer of oil or water-based cutting fluid thereon. The components G typically are arranged on the endless belt 12 in a pattern that provides sufficient access of the carburizing atmosphere to each gear component. The gear components G are transported first through a pre-heating zone Z1 where the components are heated to a carburizing temperature of about 1950 degrees F. in about 30 minutes or less, such as within 20 minutes. The heating zone Z1 is heated by electrical resistance heating elements (not shown) of the furnace. The temperature in zone Z1 is monitored and controlled by one or more thermocouples at appropriate locations in the zone Z2. An endothermic, protective (reducing) atmosphere is provided in zone Z1. For purposes of illustration and not limitation, the pre-heat atmosphere can comprise the following constituents in the following approximate proportions: 1) 20 volume % CO, 2) 40 volume % $H_2$, and 3) 40 volume % $N_2$. The atmosphere is an endothermic ASM class 302 atmosphere.

A representative pre-heating zone Z1 is ten feet in length. The opposite ends of the pre-heating zone Z1 have upstanding adjustable-height doors 20, 21 that include steel alloy chain curtains (not shown) at their lower ends through which chain curtains the gear components are transported. The doors and curtains help maintain a more or less distinct pre-heating zone Z1 and carburizing zone Z2.

Figure 2:
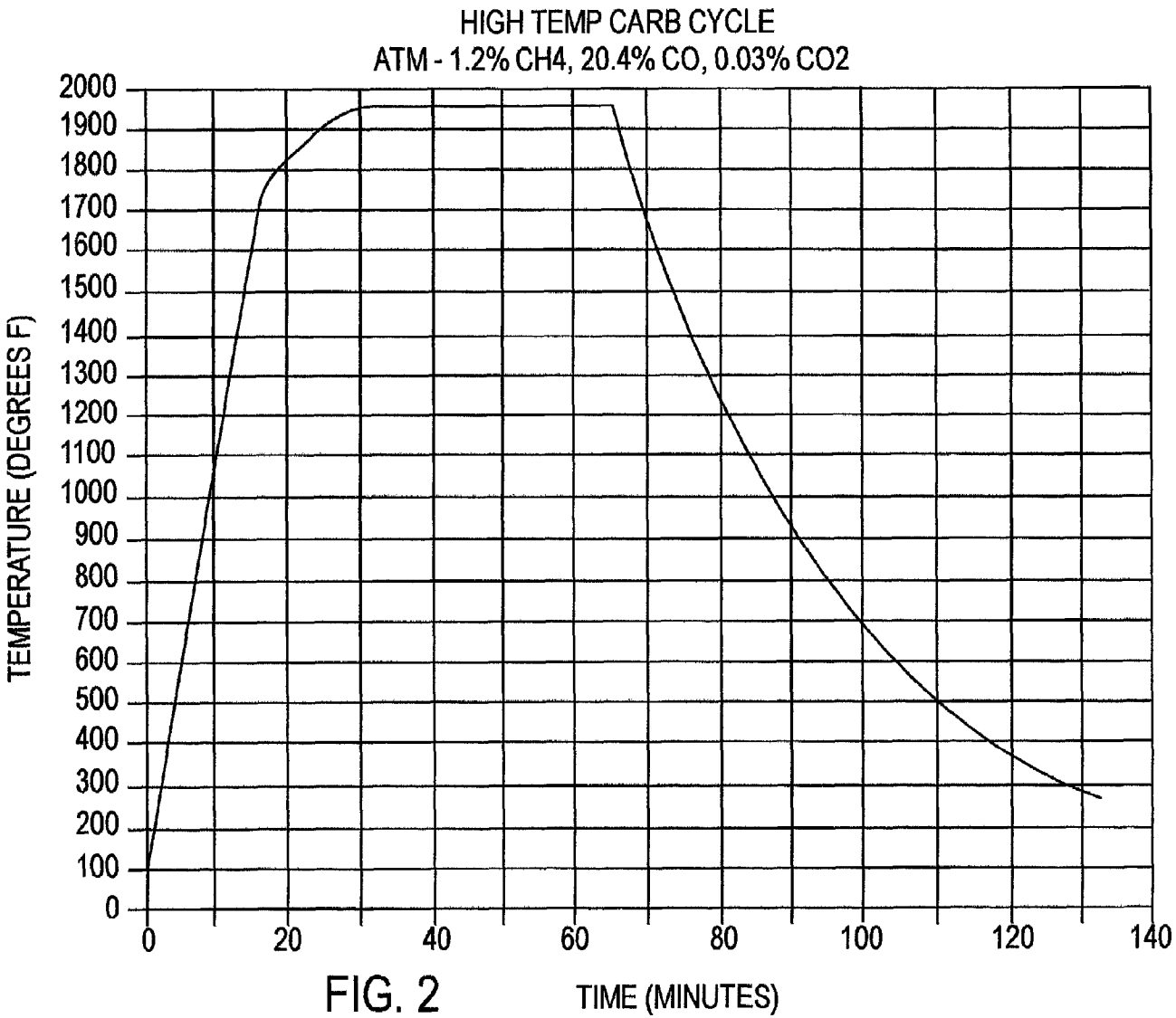
FIG. 2 is a temperature-time graph showing temperature of an automobile transmission ring gear versus time as it is transported through the belt furnace.

FIG. 2 illustrates a typical rapid heat-up curve for a steel (e.g. type 5120 or 8620) automobile transmission ring gear (approximately 4.1 pounds per gear) as it is transported through the belt furnace 10 at a belt speed of 6 inches per minute. It is apparent that the temperature of the gear was raised to about 1950 degrees F. in about 30 minutes or less as it was transported on belt 12 through the pre-heating zone Z1. The belt speed is set to provide the desired heat-up rate at a given furnace temperature and length.

In practicing the invention, the components G typically are pre-heated to a carburizing temperature of at least about 1900 degrees F., preferably between 1900 to 2000 degrees F. and more preferably 1950 degrees F. where at such relatively high carburizing temperature, the concentration of methane ($CH_4$) in the carburization atmosphere (in zone Z2) predominantly controls the rate of carburization of the components as a result of the more thermodynamically favorable carburizing reaction at such temperatures (e.g. $CH_4 = C_{Fe} + 2H_2$ where $C_{Fe}$ is carbon introduced into the steel). This methane control contrasts to control of carburization at temperatures of 1850 degrees F. and below where the concentrations of $CO_2$ and $H_2O$ predominantly control carburization. The pre-heated components G are transported on belt 12 from zone Z1 through carburizing zone Z2 that includes a carburizing atmosphere enriched with methane to carburize the component to introduce a desired amount of carbon in the component to a selected surface case depth. The carburizing atmosphere generally comprises about 1 to about 2 volume % methane (e.g. natural gas), 18-22 volume % CO, 38-42 volume % $H_2$, less than 0.1 volume % $CO_2$, and balance $N_2$, although the particular carburizing atmosphere will depend on the type of natural gas used as the methane component. The carburizing zone Z2 is heated by electrical resistance heating elements (not shown) to maintain a desired carburizing temperature. An endothermic, carburizing atmosphere is provided in zone Z2 and generally comprises CO, $H_2$, $CH_4$ and small amounts of $CO_2$ and water. For purposes of illustration and not limitation, an exemplary carburizing atmosphere can have the following constituent in the following proportions: 20.4 volume % CO, 40 volume % $H_2$, 1.2 volume % methane, 0.03 volume % $CO_2$ and balance $N_2$ at a dewpoint of −10 degrees F.

The carburizing atmosphere in zone Z2 is monitored by a infrared methane analyzer, Co analyzer, and a $CO_2$ analyzer that provide feedback to an electronic controller that can adjust levels of enriching gas (methane) to maintain a desired atmosphere composition in response to the signals from the analyzers.

A representative carburizing zone Z2 is twenty feet in length. Typically, the temperature in zone Z2 is monitored and controlled by thermocouples at three (or more or less) locations along the length of the zone Z2. The opposite ends of the zone Z2 have upstanding adjustable-height doors 21, 22 that include alloy steel chain curtains (not shown) at their lower ends through which chain curtains the gear components are transported. The doors help maintain a more or less distinct pre-heating zone Z1 and carburizing zone Z2. The carburizing gases are introduced into the zone 2 using a manifold and fan system (not shown) that promotes circulation and temperature uniformity therein. For example, recirculation fans (not shown) can be located facing the top of the belt 12 as well as facing sides of the belt 12 to maintain an active carburizing atmosphere around each component on the belt. A support hearth 25 can be disposed in the zone Z2 to support the belt 12 and thus the components thereon during carburization to reduce or prevent distortion of the components.

FIG. 2 illustrates the typical temperature versus time curve for the steel (5120 or 8620 steel) automobile transmission ring gear as it is transported through the belt furnace 10 at the belt speed of 6 inches per minute with carburizing zone Z2 having the exemplary carburizing atmosphere. The temperature (1950 degrees F.) and time in the above-described carburizing atmosphere produce a surface carbon concentration of 1.0 weight % to a depth of 0.02 inch (case depth) on the outer surfaces of the ring gear. Carburizing in the manner described is beneficial to reduce or eliminate internal oxidation in steel components G.

The belt furnace 10 typically includes a buffer zone Z3 between the carburizing zone Z2 and the cooling zone Z4. The buffer zone Z3 is an unheated, thermally insulated zone of the furnace 10 to provide a transition between the hot carburizing zone Z2 and the water-cooled cooling zone Z4. The buffer zone can be 1 to 3 feet in length.

The carburized components G are transported through the buffer zone Z3 and then through the cooling zone Z4 where the component is relatively slowly cooled to a lower temperature to produce a relatively soft, martensite-free surface case on an underlying inner non-carburized core of the components G. A typical lower temperature is below about 500 degrees F. where no detrimental oxide surface scale forms on the steel component in ambient air outside the furnace 10. The cooling zone Z4 is defined by water-jacketed furnace walls through which cooling water is flowed closed loop or open loop manner. The relatively slow cooling rate provided by transport through the cooling zone typically produces a surface case comprising substantially pearlite on a non-carburized core that comprises a mixture of pearlite and ferrite.

The gaseous atmosphere in cooling zone Z4 comprises the carry-over atmosphere from the carburizing zone Z2 (i.e. the atmosphere of zone Z2 that has flowed to cooling zone Z4, although a protective gaseous atmosphere such as nitrogen can be introduced into the zone Z4 in addition to, or in lieu of, such carry-over atmosphere from the carburizing zone Z2. A representative cooling zone Z4 is twenty to thirty feet in length. The opposite ends of the zone Z4 have upstanding adjustable-height doors 23, 24 that include alloy steel chain curtains (not shown) at their lower ends through which chain curtains the gear components are transported. The doors help maintain a more or less distinct cooling zone Z4.

Figure 3A:
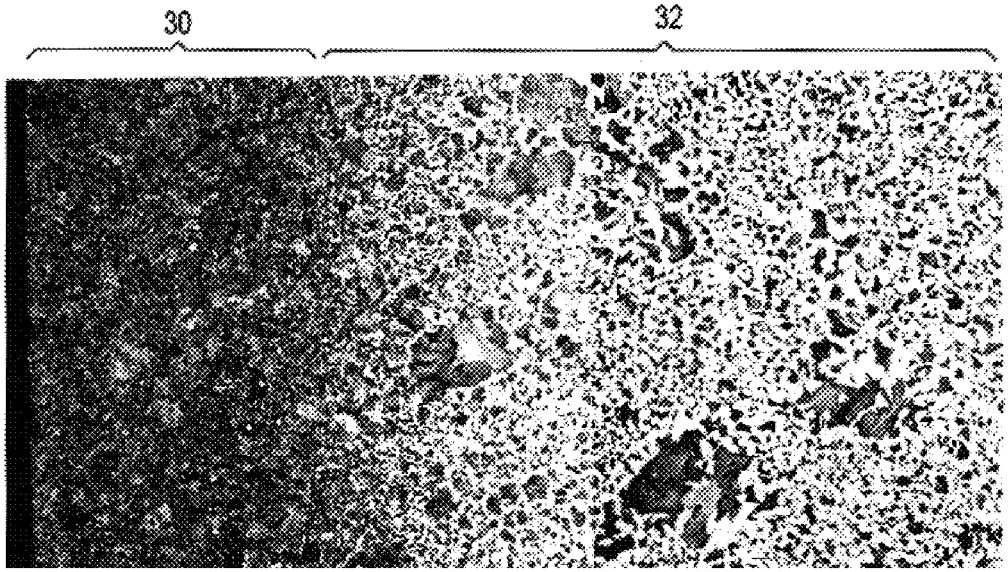
FIG. 3A is a photomicrograph at 100× of an SAE 5120 transmission ring gear (etched with 1% Nital) after carburizing and slow cooling pursuant to an embodiment of the invention.

FIG. 2 illustrates the typical temperature versus time curve for the steel (5120 or 8620 steel) automobile transmission ring gear as it is transported through the belt furnace 10 at the belt speed of 6 inches per minute with the cooling zone Z4 having the carry-over atmosphere from zone Z2. The carburized components are cooled relatively slowly in cooling zone Z4 from about 1950 degrees F. to about 250 degrees F. over a 60 minute time period. The carburized components G are relatively slowly cooled to the lower temperature to produce a soft martensite-free, substantially pearlitic surface case on an underlying inner non-carburized core that comprises a mixture of pearlite and ferrite. The carbon-enriched surface case can include minor amounts of other phases such as banite with higher alloy steels. FIG. 3A is a photomicrograph illustrating the surface case 30 and core 32 produced on a 5120 steel ring gear using the exemplary treatment parameters described above.

In one embodiment of the invention, the cooled components G are discharged out of the exit end of the belt furnace 10 to cool to ambient temperature (e.g. room temperature) for further processing. Alternately, the components G can be removed from the belt furnace while they are at a superambient temperature for further processing.

The carburized components G are subjected to a conventional harding treatment by heating them in a conventional heat treat furnace or using induction heating to a hardening temperature in the austenitic range of the particular steel used followed by conventional quenching and tempering to provide a relatively hard tempered martensitic surface case on a non-martensitic core (e.g. a core comprising a ferrite and pearlite mixture or banite depending upon alloy content of the steel). The heat treatment in the austenitic range can be conducted in a neutral, non-decarburizing atmosphere. Optionally and preferably, the heat treatment in the austenitic range can be conducted in an ammonia enriched, endothermic atmosphere (e.g. up to about 5 volume % $NH_3$ and balance endothermic atmosphere described above) to form a shallow depth of retained austenite at the outer surface of the surface case of the hardened (quenched and tempered) gear component to improve fatigue properties of the components.

For distortion sensitive steel components, the components G can be pressed in a fixture (not shown) to reduce distortion during quenching. Such fixture-quenching involves pressing each component between dies after it has been heated in the austenitic range (e.g. about 1550 degrees F.) and then quenching the component in oil, water or other suitable quenchant while pressed between the dies as is known and described in U.S. Pat. No. 4,360,189, the teachings of which are incorporated herein by reference with respect to fixture-quenching.

Figure 3B:
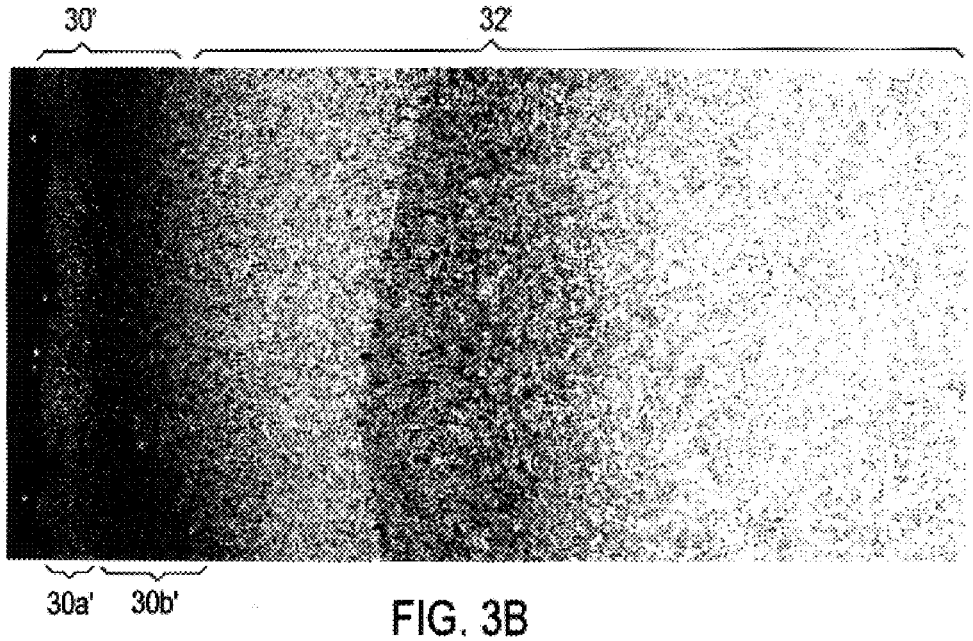
FIG. 3B is a photomicrograph at 100× of the SAE 5120 ring gear (etched with 1% Nital) after carburizing, slow cooling, and reheating, quenching and tempering.

For the steel (5120 or 8620 steel) automobile transmission ring gear carburized as described above, the hardening temperature is in the range of 1525 to 1575 degrees F. for times of 45 to 75 minutes. The components then are quenched with or without fixtures from the hardening temperature in oil (or water) to about 150 degrees F. The quenched components then are tempered the range of 325 to 375 degrees F. for times of 60 to 120 minutes to produce a tempered martensitic surface case 30' on a non-martensitic core 32' which can comprise a ferrite and pearlite mixture or banite depending upon the particular steel composition as well as the hardening temperature, time and quenching parameters employed. FIG. 3B is a photomicrograph illustrating the surface case 30' and core 32' produced on a 5120 steel ring gear using the hardening parameters described above including heat treating in the austenitic range in an atmosphere containing up to about 5 volume % $NH_3$. The surface case 30' comprises an outermost region 30*a*' comprising retained austenite to a shallow depth of 0.002 inch and an underlying tempered martensite inner region 30*b*'. The core 32' comprises pearlite, ferrite, and bainite in FIG. 3B.

The method of the invention can be used to reduce overall start-to-finish time to conduct the hardening treatment of the component wherein the rate limiting step is the carburizing treatment. A floor-to-floor carburizing time of approximately 2 hours is achievable in practice of embodiments of the invention.

Moreover, fatigue properties of steel gear components produced by practice of the invention are substantially improved as compared to those produced by the relatively low temperature carburizing and quenching technique practiced heretofore. For example, 5120 and 8620 steel automobile transmission ring gear components were carburized using exemplary parameters described above and hardened by heating in the austenitic range in a 5 volume % ammonia/balance type 302 endothermic atmosphere followed by quenching and tempering. These ring gears were evaluated in a "single tooth bending" fatigue test where a range of predetermined loads are applied to teeth of the gear and cycled to failure. The ring gears treated pursuant to the invention exhibited fatigue lives as shown in the following Table where data for conventionally treated ring gears also are shown for comparison.

The conventionally treated ring gears were treated by carburizing at 1650 degrees F. (process temp in the Table), quenching in oil, heating in austenitic range in 5% volume ammonia/balance endothermic atmosphere, oil quenched, and tempered. Some of the treated ring gears were conventionally shot peened after the hardening heat treatment. Total case depth (in millimeters) is after carburizing and heat treatment.

TABLE

HIGH LOAD/LOW CYCLE FATIGUE

| Test | cycles to failure for six tests | | | | | | Test Load | Test Gear | Trial | | Process Temp | | Total Case |
|---|---|---|---|---|---|---|---|---|---|---|---|---|---|
| Number | 1 | 2 | 3 | 4 | 5 | 6 | (Pounds) | Number | Number | Material | (Des F.) | Shotpeen | Depth |
| 1 | 4,210 | 4,050 | 4,170 | 4,060 | 3,850 | 3,600 | 10000 | 1-2 | 2 | 8620 | 1650 | No | 0.55 |
| 2 | 3,700 | 3,000 | 5,800 | 6,400 | 4,400 | 3,700 | 12000 | 3-4 | 7 | 8620 | 1650 | Yes | 0.52 |
| 3 | 14,100 | 7,900 | 8,300 | 14,500 | 16,900 | 47,900 | 12000 | 5-6 | 4 | 8620 | 1950 | No | 0.77 |
| 4 | 26,700 | 23,800 | 19,800 | 14,900 | 20,100 | 40,200 | 12000 | 7-8 | 5 | 8620 | 1950 | Yes | 0.80 |
| 5 | 7,500 | 8,850 | 15,390 | 5,720 | 4,830 | 5,230 | 10000 | 9-10 | 1 | 5120 | 1650 | No | 0.67 |
| 6 | 6,800 | 8,800 | 1,900 | 6,900 | 4,200 | 4,200 | 12000 | 11-12 | 8 | 5120 | 1650 | Yes | 0.60 |
| 7 | 42,800 | 13,500 | 23,900 | 36,800 | 42,200 | 64,700 | 12000 | 13-14 | 3 | 5120 | 1950 | No | 0.72 |
| 8 | 9,800 | 13,600 | 11,100 | 16,300 | 14,900 | 8,900 | 12000 | 15-16 | 6 | 5120 | 1950 | Yes | 0.70 |

The substantial improvement in fatigue life of the ring gears treated (process temp=1950 degrees F.) pursuant to the invention is evident from the data of the Table regardless of whether or not the ring gears were shot peened.

While the invention has been disclosed primarily in terms of specific embodiments thereof, it is not intended to be limited thereto but rather only to the extent set forth hereafter in the claims which follow.

We claim:

1. A method of carburizing a steel component, comprising:

heating said component to a carburizing temperature of about 1900 degrees F. and greater;

contacting said component at said carburizing temperature with a methane-containing endothermic carburizing atmosphere that comprises methane, carbon monoxide, hydrogen, and nitrogen for a carburization time;

monitoring concentration of methane in said carburizing atmosphere;

controlling a level of methane enrichment of said carburizing atmosphere in a substantially continuous manner by feedback control of said monitored concentration of methane according to said carburization time and said carburizing temperature, said methane enrichment controlling said carburizing atmosphere to further control carburizing of a carbon-enriched surface case on an underlying non-carburized core of said component; and cooling said component at a relatively slow rate effective to provide said surface case free of martensite on said component.

2. The method of claim 1 wherein said component is heated to said carburizing temperature of about 1900 degrees F. to about 2000 degrees F.

3. The method of claim 1 wherein said component is relatively slowly cooled to a lower temperature to produce said surface case comprising substantially pearlite on an underlying core of said component, said core comprising pearlite and ferrite.

4. The method of claim 1 including heating said component at the hardening temperature for a controlled time in the presence of ammonia to form a shallow depth of retained austenite on an outermost region of said surface case.

5. The method of claim 1 wherein said component is heated to said carburizing temperature of about 1900 degrees F. and greater in said carburizing atmosphere comprising about 1 to about 2 volume % methane, 18 to 22 volume % carbon monoxide, 38 to 42 volume % hydrogen, less than 0.1 volume % carbon dioxide, and balance nitrogen.

6. The method of claim 5 wherein said component is heated to said carburizing temperature in about 30 minutes or less.

7. A method of carburizing a steel component, comprising transporting said component through a heating zone of a furnace to heat said component to a carburizing temperature of about 1900 degrees F. and greater;

transporting said component through a carburizing zone of said furnace to carburize said component at said carburizing temperature in a methane-containing endothermic carburizing atmosphere that comprises methane, carbon monoxide, hydrogen, and nitrogen for a carburization time;

monitoring concentration of methane in said carburizing atmosphere;

controlling a level of methane enrichment of said carburizing atmosphere by feedback control of said monitored concentration of methane according to said carburization time and said carburizing temperature, wherein said level of methane enrichment is selectively modified in a substantially continuous manner to further control carburizing of a carbon enriched surface case on an underlying non-carburized core of said component; and transporting said component through a cooling zone of said furnace to cool said component at a relatively slow rate effective to provide said surface case free of martensite on said component.

8. The method of claim 7 wherein said component is transported on a belt through said furnace.

9. The method of claim 7 wherein said component is heated to said carburizing temperature in about 30 minutes or less.

10. The method of claim 7 wherein said component is relatively slowly cooled to a lower temperature to produce said surface case comprising substantially pearlite on an underlying core of said component, said core comprising pearlite and ferrite.

11. The method of claim 7 including heating said component at the hardening temperature for a controlled time in the presence of ammonia to form a hallow depth of retained austenite on an outermost region of said surface case.

12. The method of claim 7 wherein said component is heated to said carburizing temperature of about 1900 degrees F. and greater.

13. The method of claim 12 wherein said component is heated to said carburizing temperature of about 1900 degrees F. to about 2000 degrees F.

14. A method of making a steel component, comprising heating said component to a carburizing temperature, contacting said component at said carburizing temperature of about 1900 degrees F. and greater with a methane-containing endothermic carburizing atmosphere that comprises methane, carbon monoxide, hydrogen, and nitrogen for a time using methane concentration monitoring and feedback control of said carburizing atmosphere, wherein said methane concentration is selectively modified in a substantially continuous manner to control carburizing of a carbon-enriched surface case on an underlying non-carburized core of said component, cooling said component at a relatively slow rate effective to provide a surface case free of martensite on said component, heating said component having said surface case free of martensite to a hardening temperature, quenching said component, and tempering said component to form a surface case comprising tempered martensite.

15. The method of claim 14 wherein said component is relatively slowly cooled to a lower temperature to produce a surface case comprising substantially pearlite on an underlying core of said component, said core comprising pearlite and ferrite.

16. The method of claim 14 including heating said component at the hardening temperature for a controlled time in the presence of ammonia to form a shallow depth of retained austenite on an outermost region of said surface case.

17. The method of claim 14 wherein said component is heated to said carburizing temperature of about 1900 degrees F. and greater.

18. The method of claim 17 wherein said component is heated to said carburizing temperature of about 1900 degrees F. to about 2000 degrees F.

19. The method of claim 14 wherein said component is heated to said carburizing temperature in about 30 minutes or less.

20. The method of claim 19 wherein said component is quenched and tempered to form a tempered martensitic surface case on an underlying core of said component, said core comprising a mixture of ferrite and pearlite or banite.

21. A method of carburizing a steel component, comprising heating said component to a carburizing temperature, monitoring concentration of methane in a carburizing atmosphere, controlling a level of methane enrichment of said carburizing atmosphere in a substantially continuous manner by feedback control of said monitored concentration of methane according to a defined carburization time and said carburizing temperature;

contacting said component at said carburizing temperature with a methane-containing carburizing atmosphere for said carburizing time to form a carbon-enriched surface case on an underlying core of said component, and cooling said component at a relatively slow rate to a lower temperature to produce said surface case that is free of martensite and that comprises substantially pearlite on said underlying core of said component, said core comprising pearlite and ferrite.

22. The method of claim 21 wherein said component is cooled below about 500 degrees F.

23. A method of carburizing a steel component, comprising heating said component to a carburizing temperature;

monitoring concentration of methane in a carburizing atmosphere;

controlling a level of methane enrichment of said carburizing atmosphere in a substantially continuous manner by feedback control of said monitored concentration of methane according to a defined carburization time and said carburizing temperature, said methane enrichment controlling said carburizing atmosphere;

contacting said component at said carburizing temperature with said methane-containing carburizing atmosphere for said carburization time to form a carbon-enriched surface case on said component, wherein a predetermined amount of carbon is introduced to said carbon-enriched surface case to a preselected depth through said substantially continuous controlling of said level of methane enrichment of said carburizing atmosphere;

cooling said component at a relatively slow rate effective to provide said surface case free of martensite on an underlying core comprising pearlite and ferrite of said component; and heating said component at a hardening temperature for a controlled time in the presence of ammonia to form a shallow depth of retained austenite on an outermost region of said surface case.

24. A method of carburizing a steel component, comprising transporting said component through a heating zone of a furnace to heat said component to a carburizing temperature;

transporting said component to a carburizing zone of said furnace to carburize said component at said carburizing temperature in a methane-containing carburizing atmosphere, monitoring concentration of methane in said carburizing atmosphere;

controlling a level of methane enrichment of said carburizing atmosphere in a substantially continuous manner by feedback control of said monitored concentration of methane according to a defined carburization time and said carburizing temperature, said methane enrichment controlling said carburizing atmosphere;

maintaining said component in said carburizing zone for said carburization time to form a carbon-enriched surface case on an underlying core of said component; and transporting said component through a cooling zone of said furnace to cool said component at a relatively slow rate to a lower temperature to produce said surface case that is free of martensite and that comprises substantially pearlite on said underlying core of said component, said core comprising pearlite and ferrite.

25. The method of claim 24 wherein said component is cooled below about 500 degrees F. in a carry-over atmosphere from the carburizing zone.

26. A method of carburizing a steel component, comprising transporting said component through a heating zone of a furnace to heat said component to a carburizing temperature;

transporting said component through a carburizing zone of said furnace to carburize said component at said carburizing temperature in a methane-containing carburizing atmosphere for a carburization time to form a carbon-enriched surface case on said component, monitoring concentration of methane in said carburizing atmosphere;

controlling a level of methane enrichment of said carburizing atmosphere in a substantially continuous manner by feedback control of said monitored concentration of methane according to said carburization time and said carburizing temperature, said methane enrichment controlling said carburizing atmosphere;

transporting said component through a cooling zone of said furnace to cool said component at a relatively slow rate effective to provide said surface case free of martensite on an underlying core comprising pearlite and ferrite of said component; and heating said component at a hardening temperature for a controlled time in the presence of ammonia to form a shallow depth of retained austenite on an outermost region of said surface case.

27. A method of making a steel component, comprising heating said component to a carburizing temperature;

monitoring concentration of methane in a carburizing atmosphere;

controlling a level of methane enrichment of said carburizing atmosphere in a substantially continuous manner by feedback control of said monitored concentration of methane according to a defined carburization time and said carburizing temperature, said methane enrichment controlling said carburizing atmosphere;

contacting said component at said carburizing temperature with said methane-containing carburizing atmosphere for said carburization time to form a carbon-enriched surface case on an underlying core of said component, cooling said component at a relatively slow rate to a lower temperature to produce a surface case that is free of martensite on said core of said component and that comprises substantially pearlite, said core comprising pearlite and ferrite, heating said component having said surface case to a hardening temperature, quenching said component, and tempering said component to form a surface case comprising tempered martensite.

28. The method of claim 27 wherein said component is heated to a hardening temperature in an austenitic phase range.

29. A method of making a steel component, comprising heating said component to a carburizing temperature in about 30 minutes or less, monitoring concentration of methane in a carburizing atmosphere, controlling a level of methane enrichment of said carburizing atmosphere in a substantially continuous manner by feedback control of said monitored concentration of methane according to a defined carburization time and said carburizing temperature, said methane enrichment controlling said carburizing atmosphere, contacting said component at said carburizing temperature with said methane-containing carburizing atmosphere for said carburization time to form a carbon-enriched surface case on an underlying core of said component, cooling said component at a relatively slow rate effective to provide a surface case free of martensite on said underlying core comprising pearlite and ferrite of said component, heating said component having said surface case free of martensite to a hardening temperature, quenching said component, and tempering said component to form a surface case comprising tempered martensite on said core, said core comprising a mixture of ferrite and pearlite or banite.

30. A method of making a steel component, comprising heating said component to a carburizing temperature;

monitoring concentration of methane in a carburizing atmosphere;

controlling a level of methane enrichment of said carburizing atmosphere by feedback control of said monitored concentration of methane according to a defined carburization time and said carburizing temperature, said methane enrichment controlling said carburizing atmosphere;

contacting said component at said carburizing temperature with said methane-containing carburizing atmosphere for said carburization time to form a carbon-enriched surface case on said component, wherein said level of methane enrichment is selectively modified in a substantially continuous manner to introduce a predetermined amount of carbon to said carbon-enriched surface case to a preselected depth;

cooling said component at a relatively slow rate effective to provide a surface case free of martensite on an underlying core comprising pearlite and ferrite of said component, heating said component having said surface case free of martensite to a hardening temperature for a controlled time in the presence of ammonia to form a shallow depth of retained austenite on an outermost region of said surface case;

quenching said component; and tempering said component to form a surface case comprising tempered martensite having said retained austenite on said outermost region of said surface case.

* * * * *